United States Patent [19]

Riggs

[11] 4,184,272

[45] Jan. 22, 1980

[54] ATHLETIC SHOE FOR TRACK COMPETITION AND INTERVAL TRAINING

[76] Inventor: Donnie E. Riggs, 1606 Monteval Ct., San Jose, Calif. 95120

[21] Appl. No.: 918,914

[22] Filed: Jun. 26, 1978

[51] Int. Cl.[2] ..... A43B 5/00; A43C 15/00

[52] U.S. Cl. ..... 36/129; 36/67 A

[58] Field of Search ..... 36/128, 102, 126, 129, 36/114, 67 A, 67 D, 32 R, 59 R, 59 C

[56] References Cited

U.S. PATENT DOCUMENTS

| | | | |
|---|---|---|---|
| 1,181,683 | 5/1916 | Pierce | 36/114 |
| 2,095,766 | 10/1937 | Shapiro | 36/67 A |
| 3,535,799 | 10/1970 | Onitsuka | 36/102 |
| 3,918,181 | 11/1975 | Inohara | 36/59 C |
| 4,085,527 | 4/1978 | Riggs | 36/114 |

*Primary Examiner*—Patrick D. Lawson
*Attorney, Agent, or Firm*—Gerald L. Moore

[57] ABSTRACT

A shoe for sprinters, middle distance and distance runners incorporating sharp spikes or like traction devices under the toe portion and raised cushion cleats under the heel portion for maintaining the heel in an elevated position for a good running posture and to provide cushioning as well as traction during heel contact. Also, the elevated heel portion reduces excess strain on the Achilles' tendon of the middle distance and long distance runners.

8 Claims, 4 Drawing Figures

ATHLETIC SHOE FOR TRACK COMPETITION AND INTERVAL TRAINING

BACKGROUND OF THE INVENTION

The act of running may be divided functionally into sequences involving heel contact, forefoot contact, heel-off and toe-off functions. The foot pronates on contact with the ground as the leading leg is extended forward. With middle distance and long distance runners, it is usual for the heel to contact the ground first as is true for joggers and walkers. In sprinting, it has been assumed that the runner usually lands on the ball of the foot and the heel seldom contacts the surface. For this reason, presently used track shoes for sprinters have spikes or similar traction devices under the toe and ball portions and have no traction or elevation devices under the heel portion.

Studies have now shown that certain prior assumptions concerning the foot positions during sprinting have been erroneous. By high speed photography, it can be shown that sprinters do make initial contact with the forefoot but then reduce from this elevated position as (1) the propulsive force is exerted by the sprinter and as (2) the fatigue factor increases during the latter stages of the event.

It is the purpose of the present invention to provide a shoe especially adapted for sprinting and running to accommodate the heel-contact phase of the running sequence.

SUMMARY OF THE INVENTION

An athletic shoe for sprinters and runners having spikes or like traction devices under the toe portion and having raised resilient cleats under the heel portion to cushion the foot and provide traction during heel contact and to elevate the heel and maintain an efficient running posture.

DESCRIPTION OF THE INVENTION

As described before, the biomechanics of sprinting usually involve forefoot contact and toe-off movements. Athletic shoes are provided for runners to support the foot in the proper attitude and maintain traction with the ground. Naturally the efficiency of the runner is greatly diminished if the foot slides on the ground especially during the toe-off movement. In addition any improper positioning or rotation of the foot will yield less efficient running biomechanics such as can happen if the heel is lowered into contact with the running surface.

Figure 1:
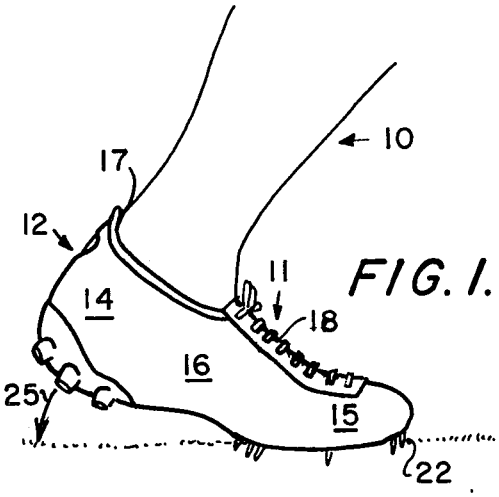
FIG. 1 shows a foot in an athletic shoe during the propulsion stage of running.
Figure 2:
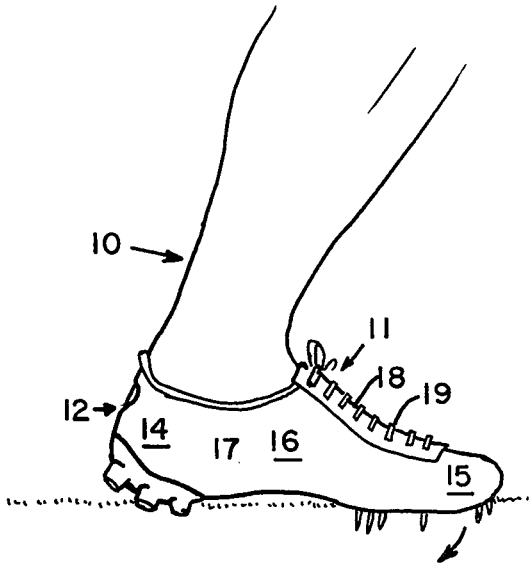
FIG. 2 shows the heel-down attitude of the foot frequently encountered as the foot contacts the running surface.

A shoe of the type embodying the present invention is shown in FIGS. 1 and 2 illustrated during the forefoot contact and a heel-down stage of running. Therein the leg 10 and foot 11 of the wearer are shown with a shoe 12. Generally speaking, such a shoe includes an upper portion or shell comprising a heel portion 14 and a toe portion 15 joined by a midportion 16. The midportion

16 includes a top opening 17 through which the ankle extends with a connecting front opening 18 closed by lacings 9 for securing the shoe on the foot. The shoe upper portion usually is made of a lightweight leather or synthetic material which is sufficiently resilient so as not to hamper the normal bending motions of the foot.

Shown in FIG. 1 are the foot and leg prior to the toe-off phase of running or walking. During this phase the leg is more or less straight and the muscles are used to propel the body (not shown) forward. During running the toe of the trailing foot is lifted from the ground prior to contact by the heel of the leading or forward foot. FIG. 2 shows the foot in the heel-contact phase as occurs during middle and long distance running and jogging. In such motion the heel contacts the ground first and thereafter with rotation of the foot, the forefoot rotates to the ground. Such motion is followed by the toe-off movement shown in the initial stages in FIG. 1.

To maintain traction during the toe-off movement of running during which the body is pushed forward, the shoe includes a sole 20 extending beneath the toe portion 15 and the midportion 16. In the embodiment shown, the sole 20 is made of a rubber or similar composition which is glued to the adjacent upper shoe portions. Formed in the lower or exposed surface of the sole are a plurality of closely spaced projections 21 which are molded directly into the sole and are generally conical in configuration. These projections are well-known and are approximately two millimeters in diameter and two to three millimeters in height.

Also fixed to this sole portion generally under the toe portion of the shoe are a plurality of rigid metallic spikes 22 which are approximately six millimeters long. Such spikes are one to two millimeters in diameter and are pointed on the end to penetrate a running surface and provide traction especially during the toe-off phase of running. These spikes are attached to a base 24 which is fixed to the shoe in a suitable manner such as by being threaded into a recess (not shown) molded into the shoe sole. In the illustration are shown six spikes 22 fixed beneath the toe portion of the shoe for providing traction with the surface. Obviously these spikes penetrate the surface sufficiently to provide traction between the shoe and ground. Thus the toe and forefoot parts of the foot are supported at nearly the same elevation as the heel portions in such shoes with penetration of the spikes into the running surface.

It is known that for most sprinters the forefoot contacts the running surface first. Thereafter the forefoot rotates into full contact with the ground as the body moves forward, followed by the heel being lifted to initiate and maintain the toe-off stage of running. This action allows the pushing of the body forward just prior to lifting the rear foot from the ground.

However during sprinting, the most efficient running posture is the forward lean position to obtain the most leverage for propelling the body forward. To facilitate this body position the runner should maintain the heel elevated. At times there occurs a lowering movement of the heel followed by contact of the heel with the running surface because the forward motion of the body during the support phase of running resulted in a counter rotation of the foot and a lowering of the heel.

Figure 3:
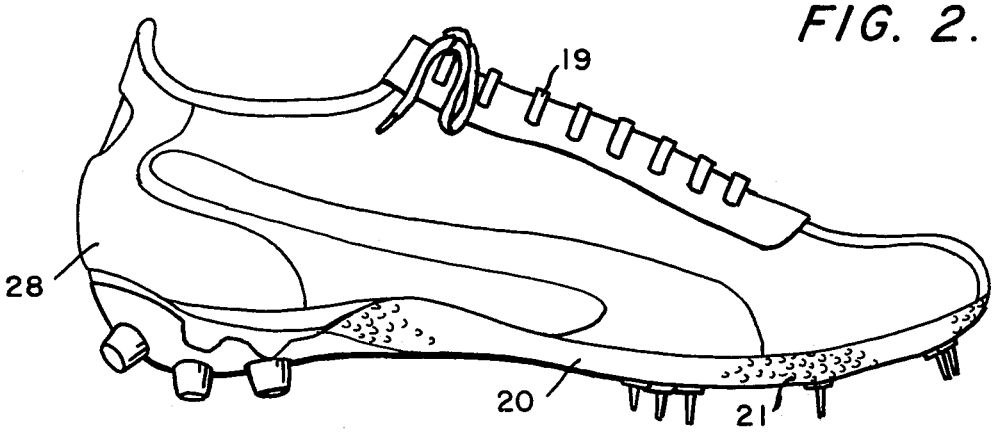
FIG. 3 is a side elevation view of an athletic shoe embodying the present invention.
Figure 4:
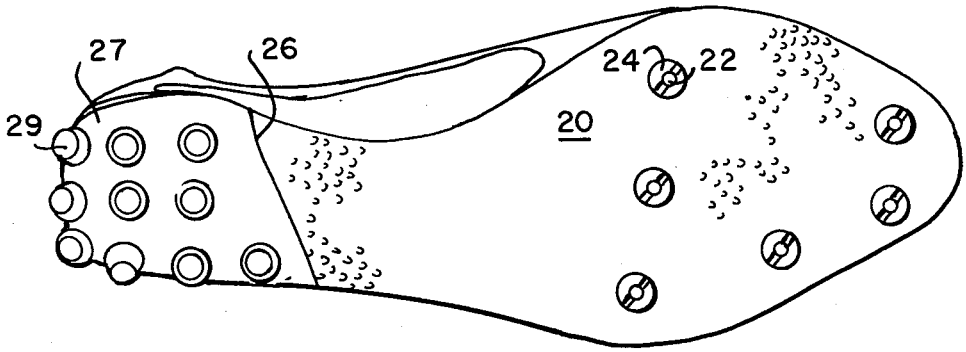
FIG. 4 is a bottom view of the shoe of FIG. 3.

In accordance with the present invention there is provided an athletic shoe of the type previously described wherein the sole portion under the heel of the shoe includes a plurality of lugs for maintaining the heel at a raised position, for cushioning the heel by providing a resilient action and for providing traction with the ground to improve the biomechanics of the runner. Thus as shown primarily in FIGS. 3 and 4 the midportion 20 of the sole is terminated along the line 26 adjacent the heel portion of the sole. The sole portion 27 beneath the heel portion 14 extends back to the rear edge 28 of the shoe and if desired, can be extended slightly up around the rear side of the shoe heel. Fixed to the sole portion 27 are a plurality of resilient lugs or cleats 29 which preferably are frusto-conical in configuration with the larger diameter portion being fixed to the sole 27. In the embodiment shown there are nine such lugs attached to the heel portion of the sole.

The lugs 29 preferably are formed integrally with a sole portion 27 with both the sheet member forming that sole portion and the lugs preferably made of a rubber-like composition which retains its shape but will deform under pressure. Thus as the heel contacts the ground during running in the manner shown in FIG. 2, the lugs grip the surface to prevent sliding and cushion the heel during the impact. As the body weight is shifted further forward, the lugs continue to compress from the force of the body weight. Thereafter with rotation of the body forward, the foot is assisted in assuming the forefoot contact position by the force of decompression of the compressed lugs returning to the original shape as the body weight is released therefrom and there is created a resilient reaction by the compressed lugs.

In addition the heel is maintained in a position elevated above the forefoot even with the foot resting on the ground. The spikes 22 penetrate the ground or running surface while the lugs 29 merely compress, but not so completely as to allow the sole portion 27 to reach ground level. Then even if the runner tends to lower the heel, the foot will be maintained in the heel-elevated position for good running posture for reducing stress on the Achilles' tendon. Also if counter-rotation of the foot occurs to lower the heel, the reverse rotation necessary to again reach the toe-off position is facilitated by first the compression followed by the expansion of the lugs.

The invention claimed:

1. An athletic shoe comprising, in combination:

an upper shell comprising a heel portion, midportion and toe portion for fitting around the foot of the wearer;

a sole fastened to said upper portion and having a bottom surface positioned to contact the ground;

a plurality of rigid spikes fixed to the sole bottom surface adjacent said toe portion and extending substantially vertically therefrom; and a plurality of resilient cleats fixed to the sole bottom surface adjacent said heel portion and extending substantially vertically therefrom to support the sole bottom surface off of the ground when the wearer places his heel on the ground.

2. An athletic shoe as defined in claim 1 wherein said rigid spikes are metallic.

3. An athletic shoe as defined in claim 2 wherein said cleats are frusto-conical in shape with the larger diameter portion being fixed to the sole bottom surface.

4. An athletic shoe as defined in claim 3 wherein said cleats are positioned to extend partway upward along the heel portion of the shoe upper shell.

5. An athletic shoe as defined in claim 4 wherein said sole bottom surface adjacent the toe and midportions includes small resilient projections having a length substantially less than the length of said spikes.

6. In combination with an athletic shoe having a heel portion and, having an upper shell and a sole fixed thereto with a plurality of rigid spikes fixed to the sole under a toe portion of the shoe; and a plurality of resilient cleats fixed to the sole beneath the shoe heel portion and extending substantially perpendicular to the sole and parallel to the spikes to support the heel portion of the shoe.

7. In combination with an athletic shoe as defined in claim 6, said cleats being formed integrally to project from one surface of a sheet member; and means fixing said sheet member to said shoe sole so the cleats extend outward from the sole.

8. In combination with an athletic shoe as defined in claim 7 wherein said cleats are frusto-conical in shape.

* * * * *